United States Patent [19]

Kölblin et al.

[11] Patent Number: 4,995,316

[45] Date of Patent: Feb. 26, 1991

[54] SCREEN PRINTING MACHINE SQUEEGEE SUPPORT ARRANGEMENT

[75] Inventors: Karl Kölblin, Emmendingen; Peter Geiger, Teningen, both of Fed. Rep. of Germany

[73] Assignee: KG Maschinenfabrik, Fed. Rep. of Germany

[21] Appl. No.: 268,976

[22] Filed: Nov. 9, 1988

[30] Foreign Application Priority Data

Nov. 9, 1987 [DE] Fed. Rep. of Germany ..... 3738039

[51] Int. Cl.[5] ..... B41F 15/46

[52] U.S. Cl. ..... 101/123; 101/114

[58] Field of Search ..... 101/114, 123, 124, 126, 101/129

[56] References Cited

U.S. PATENT DOCUMENTS

| | | | |
|---|---|---|---|
| 3,885,493 | 5/1975 | Jaffa | 101/123 |
| 4,102,266 | 7/1978 | Porth | 101/124 |
| 4,404,903 | 9/1983 | Cromin | 101/123 |
| 4,586,433 | 5/1986 | Jaffa et al. | 101/123 |
| 4,779,529 | 10/1988 | Ericsson | 101/123 |

FOREIGN PATENT DOCUMENTS

| | | |
|---|---|---|
| 1209576 | 1/1966 | Fed. Rep. of Germany . |
| 3207403 | 9/1983 | Fed. Rep. of Germany . |
| 12405868 | 8/1960 | France . |
| 2585288 | 1/1987 | France . |
| 2048780 | 12/1980 | United Kingdom . |

OTHER PUBLICATIONS

Product Brochure Thieme Typ 2000E Machine.

*Primary Examiner*—Edgar S. Burr
*Assistant Examiner*—Moshe I. Cohen
*Attorney, Agent, or Firm*—Evenson, Wands, Edwards, Lenahan & McKeown

[57] ABSTRACT

Known screen printing machines, which have a continuous support for the squeegee, have the disadvantage that the printing is impaired when the support bends. This also applies to constructions with a squeegee support which is independent of the support and the weight of which, in the case of an asymmetrical squeegee arrangement, results in an uneven loading of the squeegee. According to the invention, the support is therefore disposed rigidly at the guide rails, and pneumatic double-action cylinders are arranged directly at the support, the squeegee being fastened at the cylinders so that its angle can be adjusted. A bending off the support does not influence the printing quality, even if the squeegee is not arranged in the center of the support.

15 Claims, 2 Drawing Sheets

SCREEN PRINTING MACHINE SQUEEGEE SUPPORT ARRANGEMENT

BACKGROUND AND SUMMARY OF THE INVENTION

The invention relates to a screen printing machine having a printing table and a squeegee which can be moved over this printing table and is held at a support by means of a squeegee holder, which support moves in guide rails, via guiding devices, wherein this squeegee can be adjusted at a distance as well as at an angle with respect to the printing table and can be pressed against the printing table by means of pressure cylinders.

Screen printing machines are known (Brochure Model 3000 of Thieme Maschinenfabrik, Printed 3/86), in which the squeegee with its squeegee holder is arranged fixedly at the support which can be moved reciprocatingly by means of claw-type clamping pieces. In these constructions, the pressure of the squeegee is carried out by a vertical adjustment of the support, which takes place in that the position of the support is adjusted manually by means of lateral threaded spindles with a precision scale. The lift-off movement of the squeegee, when the supports are moved back, takes place mechanically by means of corresponding eccentrics. In the case of these constructions, the printing quality depends on the exact adjustment of the support with the squeegee. When the lengths of the support are large, and when the pressures of the squeegee are high, the deformation occurring in the support may result in errors during the printing operation.

Therefore, screen printing machines have also become known (Brochure Thieme Maschinenfabrik Model 2000 E), in which in order to achieve a uniform contact pressure onto the squeegee, the support is equipped with an additional squeegee support which is disposed with respect to the support, so that it can be moved by a small amount. This squeegee support is pressed against the printing table, by means of pneumatic cylinders, during the operation of the squeegee. The lifting-off of the squeegee during the return movement, as in the case of the other known constructions, takes place by the mechanical raising of the whole support. The angular adjustment of the squeegee with respect to the printing table also takes place by a swivelling of the whole support. Even though in the case of these constructions a bending of the support, which takes place at high squeegee pressures, cannot result directly in a deformation at the squeegee, the use of such constructions is possible without any impairment of the printing only if the squeegee is held symmetrically with respect to the center of the support. During the production of printed material which requires only a part of the width of the printing table, for example, in the case of the application of a lateral printing to an otherwise finished poster, the squeegee, which in this case has a much shorter construction than the support, has to be mounted off-center at one side of the support. However, the weight of the squeegee support, which extends over almost the whole width of the support and can be moved with respect to the support, will then have a negative effect on the printing quality because it has a one-sided effect on the squeegee. The consequences are the more disadvantageous, the lower the contact pressure to be used for the printing. In addition, the known constructions are relatively heavy and therefore expensive because of the necessity of the arrangement of two supports.

An object of the invention is therefore to construct a screen printing machine of this type such that the position of the squeegee at the support and the size of the squeegee have no influence on the printing quality.

In order to achieve this object, it is provided according to the invention in the case of a screen printing machine of the initially mentioned type that the support, is disposed directly in the guide rails, with both ends, and that the pressure cylinders are double-action pressure cylinders and are designed as guiding devices which are longitudinally slidably fastened at the support and are equipped with swivel guides for the squeegee holder. By means of this construction, on the one hand, the vertical-adjustment devices for the support are not required at its ends. On the other hand, the devices for the raising of the support during the return movement are also not necessary, and it is no longer necessary to carry out the angular adjustment of the squeegee by means of a swivelling of the whole support. As a result of the construction according to the invention, it is sufficient to arrange the pressure cylinders, which are constructed as guiding devices, directly at the support. Since these guiding cylinders can be acted upon by the same pressure, the squeegee holder with the squeegee rubber, which now is fastened directly at the guiding cylinders, can be pressed uniformly against the printing table without the damaging effect of deformations of the support which occur particularly at high pressures and with long squeegees. In the new construction, the squeegee holder itself is also not bent. By mean of the arrangement of the swivel guides at the cylinders, the angular adjustment of the squeegee may also take place in a very simple manner, without the requirement of disposing the support in its guide rails in a costly manner. The invention therefore permits a particularly simple construction of the squeegee device, which also has the advantage that the lift-off movement of the squeegee can be carried out by the guiding cylinders. In this manner, a steady straight-line motion of the support can also be provided which is not affected by adjusting devices between the rails and the support. The guiding can therefore become very precise. The printing quality may be improved, since also any possible bending of the support has no effect. Finally, it makes no difference whether or not, in the new construction, the squeegee is arranged symmetrically with respect to the support. By means of the complete uncoupling of the squeegee suspension from the support, deformations of the support remain without any influence on the contact pressure of the squeegee. As a result of the new construction, the whole arrangement can also be much lighter and the manufacturing expenditures become lower.

In advantageous preferred embodiments of the invention the support may be constructed as a hollow-profile support, for example, of light metal, and will then be very sturdy, but still light. This hollow-profile support may be provided with grooves at at least one outer side, in which the pressure cylinders, which are housed in the holding devices, may be clamped in a longitudinally slidable manner.

Certain preferred embodiments advantageously and in a simple manner provide that the swivel guide is comprised of a circular link guide, which is mounted at the lower end of the piston rod of the pressure cylinders and which, at the counterpart which is slidable in the link, is provided with a clamping profile piece which corresponds to the profile of the squeegee support to be applied and to the profile of fastening claws which are known per se. In this Case, it becomes possible to transfer the swivel shaft of the link guide in the area of the squeegee edge facing the printing table, so that, when the angular position is changed, the slope of the squeegee rubber is changed with respect to the table, but not the position of the squeegee edge in the direction of the squeegee movement with respect to the printing table. An adjustment of the starting position of the support is therefore not necessary again when the angular position of the squeegee is changed.

Finally, advantageous embodiments are contemplated with not only one squeegee, but also a presqueegee assigned to the support. In this case, the same pressure cylinders may be used also for the guiding of the presqueegee assigned to the support. In order to avoid that the presqueegee rests on the screen with an excessive pressure, when the return movement of the squeegee takes place, the pressure cylinder assigned to the presqueegee may be provided with a vertical-adjustment device, which may simply consist of an adjusting or counternut, which is assigned to the end of a correspondingly constructed piston rod of the pressure cylinder which projects out of the cylinder on top.

Other objects, advantages and novel features of the present invention will become apparent from the following detailed description of the invention when considered in conjunction with the accompanying drawings.

DETAILED DESCRIPTION OF THE INVENTION

Figure 1:
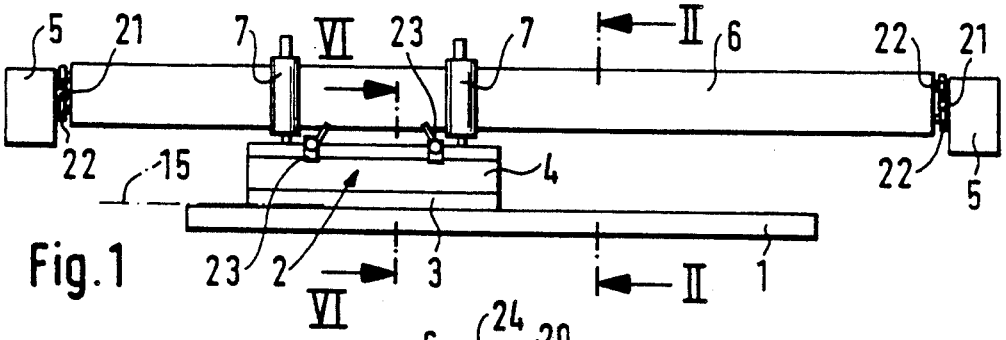
FIG. 1 is a schematic view of the squeegee device of a screen printing machine constructed according to the invention, viewed in the direction of the movement of the squeegee.
Figure 2:
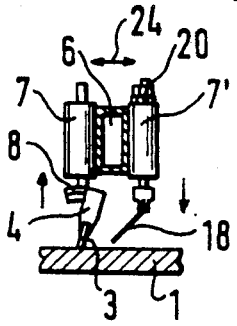
FIG. 2 is a schematic representation of the section through the squeegee device of FIG. 1, along Line II—II.

FIGS. 1 and 2 show a squeegee device of a screen printing machine according to the invention, which has a printing table 1, which, in a manner not shown in detail, is held in a machine frame. Two guide rails 5, which may consist of side members, and which extend in parallel to one another and to the sides of the printing table 1, are assigned to the printing table 1 and are also held in the machine frame. StriP-tyPe rails 21 are mounted at the guide rails 5, in each case, at the sides facing one another. Guide rollers 22 of a support 6 move at the rails 21, this support 6 spanning the whole printing table 1 and extending essentially in parallel with respect to the printing table 1. The rollers 22, which extend above and below the rails 21, are connected directly with the front faces of the support 6. In this manner, the support 6 is guided rigidly between the guide rails 5.

Pressure cylinders 7, 7' are provided longitudinally slidably at the support 6, which will be explained with reference to FIG. 3 and 4. These pressure cylinders 7, 7' are arranged at the two transverse sides of the support 6 as shown in FIG. 2. At the lower end of the piston rod of the two pressure cylinders 7 shown in FIG. 1, a swivel guide 8 (FIG. 2) is arranged, which will be explained in detail with reference to FIGS. 3 and 4. At this swivel guide 8, one squeegee holder 4 respectively with a squeegee rubber 3 is fastened by means of clamping pieces 23. At the pressure cylinders 7', a presqueegee 18 is arranged, the position of which with respect to the printing table 1 can be adjusted by means of a vertical-adjustment device which is assigned to the pressure cylinder 7'. This vertical-adjustment device, in the shown embodiment, consists of an adjusting nut 20, possibly with a counter nut, which is assigned to the upper end of the piston rod 17 projecting out of the pressure cylinder 7'.

As shown in FIG. 2, the support 6 is moved reciprocatingly over the printing table 1 in the direction of the Arrows 24 by means of driving devices, which are not shown. According to the moving direction, in this case, either the presqueegee or the squeegee support 4 with the squeegee rubber 3 are pulled upward which takes place by means of the effect of the double-action pressure cylinders 7, 7' and in operating rhythm which.

Figure 3:
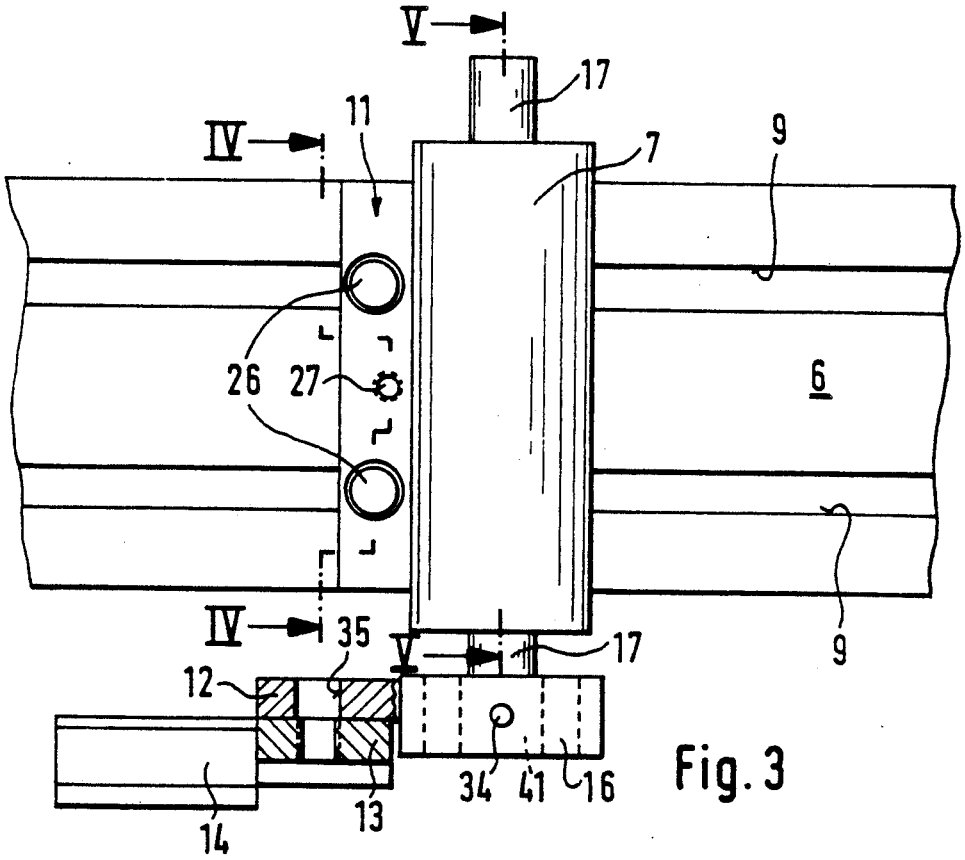
FIG. 3 is an enlarged detail of one of the pressure cylinders in a view that is similar to FIG. 1, but without any squeegee holder.
Figure 4:
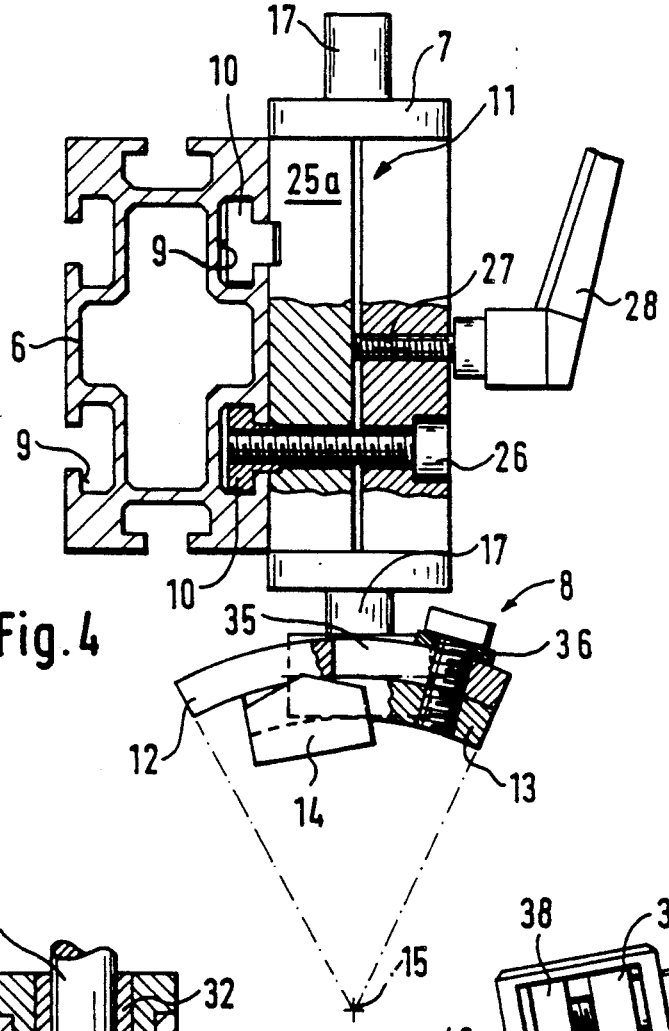
FIG. 4 is a sectional view of the device according to FIG. 3 along line IV—IV.

FIGS. 3 and 4 show that the support 6 is constructed as a hollow profile which, at the two sides which are each arranged in moving directions 24, are provided with grooves 9 of a T-shaped cross-section. Slide rings 10 are inserted in these grooves which press a clamping bridge 11 against a flange **25*a* of the cylinder 7 and thus are able to hold the cylinder 7 longitudinally slidably in the direction of the grooves 9. For this purpose, the clamping bridge 11 is connected with the slide rings 10 by means of studs 26. By means of the T-screw 28 with the threaded shaft 27, it can be pressed away from the flange 25*a*, so that as a result, the position of the holding device 11 at the support 6** is secured.

Figure 5:
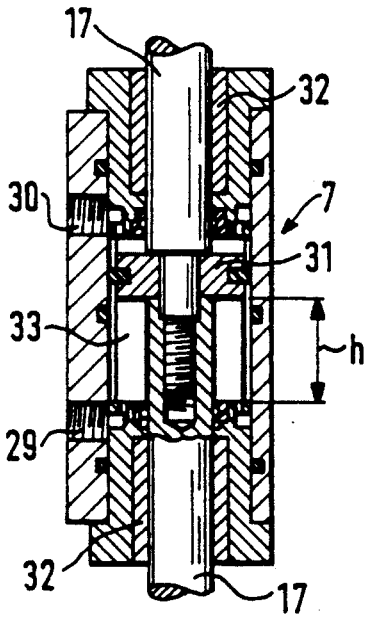
FIG. 5 is a sectional view of the pressure cylinder of FIG. 3 along the line V—V.

As shown in FIG. 5, the pressure cylinders 7—analogously, the pressure cylinders 7'—are constructed as pneumatic double-action cylinders, which are each provided with two pressure connections 29, 30, which are provided above and below the piston 31. The piston 31, toward both sides, continues as a piston rod 17, which is guided continuously in the bearing bushes 32 of the cylinder 33, this piston rod 17 consisting of two segments, which are screwed into one another and between which the piston 31 is held. A square piece 41 is pressed onto the end of the piston rod, which projects on the bottom from the cylinder 33. A frame 16 is pivotably guided around a shaft of the pin 34 at this square piece 41. A circularly arched link 12 with a longitudinal slot 35 is fixedly connected with the frame 16. A counterpart 13, which in its shape is adapted to the link 12, is held by means of a clamping screw 36 in the longitudinal slot 35. The counterpart 13, in turn, is provided in one piece with a clamping profile piece 14, which projects a distance away from the counterpart 13 in the direction in parallel to the support 6 or the printing table 1. The clamping profile pieces 14 of the two pressure cylinders 7 shown in FIG. 1 face away from one another.

Figure 6:
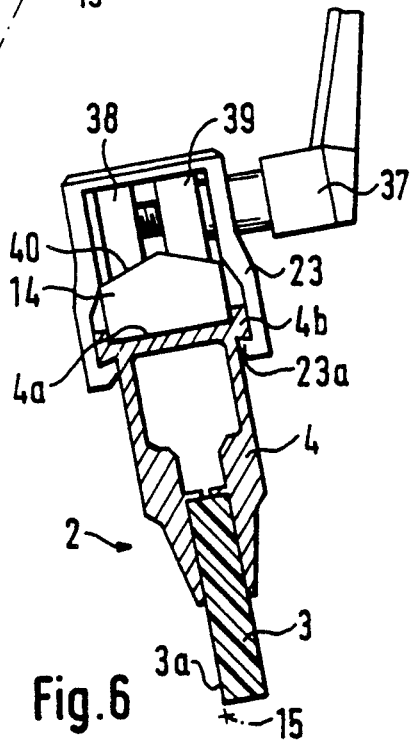
FIG. 6 is an enlarged detail of the section along the Line VI—VI in FIG. 1.

As shown in FIG. 6, the upper contact edge **4*a* of the squeegee holder 4 is placed onto these clamping profile pieces 14, and the squeegee holder 4 will then—in a manner known per se—be fixedly held at the clamping profile pieces 14 by means of a claw-type clamping piece 23 which, by means of hooks 23***a*, reaches behind corresponding projections 4*b* of the squeegee holder 4. This takes place in that the clamping pieces 23 are provided with sliding blocks 38, 39 which can be adjusted with respect to one another by means of a screwing movement caused by the T-screw 37, these sliding blocks 38, 39 sliding at roof-type inclined planes 40 of the clamping profile piece 14 and during their movement, which must take place on top of one another, moving the clamping piece 23 away from the squeegee support 4 in upward direction, and as a result, pressing the squeegee support 4 against the clamping profile piece 14.

The squeegee holder 4 with the squeegee rubber 3 which is fixedly connected, in this manner, with the piston rods 17 of the cylinders 7 Can be adjusted in a simple manner in its angle with respect to the printing table in that, after the unscrewing of the clamping screw 36 (FIG. 4), the desired swivel adjustment of the counterpart 13 with respect to the link 12 takes place, after which the clamping screw 36 is tightened again. In this case, the construction of the link 12 and of the counterpart 13 is such that the swivel shaft 15 of the link 12—see FIG. 6—extends approximately at the edge 3*a* of the squeegee rubber 3 facing the printing table. Although a swivel movement of the squeegee as a result causes an angular change of the adjustment of the squeegee rubber with respect to the printing table, there is no change of the relative position of the squeegee edge 3*a* with respect to the printing table. In the case of an angular adjustment of the squeegee rubber, therefore, as a result of this construction, no new adjustment is required of the position of the support with respect to the printing table for the start of the squeegee movement.

The hollow-profile support 6 preferably consists of light metal. Since it is disposed directly at the guide rails 5, it may be constructed to be light. Its bending, in the case of a high squeegee pressure, is not important, because the squeegee can be placed against the printing table 1 with a uniform pressure by means of the two pressure cylinders 7, irrespective of whether the support 6 is bent or not. As shown in FIG. 1, it is therefore also possible to arrange the squeegee asymmetrically with respect to the center of the support 6, without any resulting disadvantages concerning the quality of the produced sCreen printing. Since also the pressure cylinders 7, 7' are relatively simple and light in their construction, and since, in addition, the squeegee holder 4 is not fastened at a continuous support piece, but only at clamping profile pieces of a short length, the new development makes it possible to achieve a very light construction.

It is also possible to fasten the squeegee holder 4 at the support by means of more than only two pressure cylinders, if it should appear expedient because of the length of the squeegee holder. For reasons of a uniform transmission of force, care should be taken in this case that the arrangement of the fastening points is distributed over the length of the squeegee support as evenly as possible.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A screen printing machine comprising a printing table;

a support extending transversely of the printing table and guidingly supported at guide rail means disposed at opposite sides of the printing table;

pressure cylinder means connected to and carried by the support;

squeegee holder means carried by the pressure cylinder means for movement therewith, and pressure control means for controlling pressure applied via the pressure cylinder means to the squeegee holder means during printing operations;

whereby squeegee printing pressures can be controlled independently of the spacing between the support and printing table, wherein the pressure cylinder means includes a plurality of double acting pressure cylinders and associated squeegee holder means spaced along the length of a squeegee means being held thereby; and wherein the squeegee holder means includes swivel guide means for adjustable pivotally mounting the squeegee means at the pressure cylinder means.

2. A screen printing machine according to claim 1, wherein the support is constructed as a hollow-profile support, which has grooves at at least one outer side into which the pressure cylinders are clamped with slide rings.

3. A screen printing machine according to claim 1, wherein the pressure cylinders are fastened by means of fastening devices which are provided with slide rings.

4. A screen printing machine according to claim 1, wherein the swivel guide means comprises a circular link, in which a circular counterpart 13 is slidably guided, which is provided with a clamping profile piece for the squeegee holder, which projects away laterally.

5. A screen printing machine according to claim 4, wherein a swivel shaft of the link coincides approximately with the surface of the printing table and is arranged so that it extends in the area of the squeegee edge facing a printing table.

6. A screen printing machine according to claim 5, wherein the link is mounted at the free lower end of the piston rod of the assigned pressure cylinder by means of a fastening ring.

7. A screen printing machine according to claim 4, wherein the clamping profile piece of the counterpart extends in parallel with respect to the swivel shaft of the link.

8. A screen printing machine according to claim 1, wherein the stroke (h) of the pressure cylinders corresponds at least to the desired-distance adjustment of the squeegee.

9. A screen printing machine according to claim 1, wherein, at the support, pressure cylinders are mounted on both sides, for the guiding of a squeegee and of a presqueegee, and wherein the pressure cylinder, by means of which the presqueegee is guided, is equipped with a vertical-adjustment device.

10. A screen printing machine according to claim 9, wherein the pressure cylinders are respectively equipped with a piston rod, which rod emerges from the cylinder on both sides, and wherein the vertical-adjustment device consists of an adjusting nut which is assigned to the upper end of the piston rod projecting out of the cylinder, this adjusting nut being used for limiting the stroke in downward direction.

11. A screen printing machine according to claim 8, wherein the support is constructed as a hollow-profile support, which has grooves at at least one outer side into which the pressure cylinders are clamped with slide rings.

12. A screen printing machine according to claim 8, wherein the pressure cylinders are fastened by means of fastening devices which are provided with slide rings.

13. A screen printing machine according to claim 10, wherein the stroke (h) of the pressure cylinders corresponds at least to the desired-distance adjustment of the squeegee.

14. A screen printing machine according to claim 8, wherein, at the support, pressure cylinders are mounted on both sides, for the guiding of a squeegee and of a presqueegee, and wherein the pressure cylinder, by means of which the presqueegee is guided, is equipped with a vertical-adjustment device.

15. A screen printing machine according to claim 8, wherein said pressure cylinder means includes pneumatic pressure actuated double acting piston means.

* * * * *